US005746345A

United States Patent [19]

Zurawin

[11] Patent Number: 5,746,345

[45] Date of Patent: May 5, 1998

[54] STACKABLE PAINT ROLLER TRAY WITH INTEGRAL PAINT BRUSH STORAGE TROUGH REST

[76] Inventor: Michael Zurawin, 350 E. 79th St., New York, N.Y. 10021

[21] Appl. No.: 756,545

[22] Filed: Nov. 26, 1996

Related U.S. Application Data

[63] Continuation-in-part of Ser. No. 950,746, Feb. 26, 1996.

[51] Int. Cl.[6] ..... B65D 25/00

[52] U.S. Cl. ..... 220/735; 220/736

[58] Field of Search ..... 220/735, 23.8, 220/697, 698, 736

[56] References Cited

U.S. PATENT DOCUMENTS

| | | | |
|---|---|---|---|
| 4,386,703 | 6/1983 | Thompson et al. | 220/23.8 |
| 4,729,489 | 3/1988 | Papaianni | 220/23.8 |
| 5,322,183 | 6/1994 | Strachan | 220/735 |
| 5,339,976 | 8/1994 | Thornton | 220/735 |

*Primary Examiner*—Joseph M. Moy

*Attorney, Agent, or Firm*—Graham & James LLP

[57] ABSTRACT

A stackable paint roller tray having a sloping bottom and a deep well, containing paint, for roller insertion and uniform coating of a paint roller with paint. Narrow based troughs, adapted for accommodation of paint brushes, depend from the rear wall of the tray, adjacent the deep well, and are spaced therefrom to permit stacked nesting. The paint brush troughs are slopingly narrowed to permit the stacked nesting while also accommodating a major portion of a brush. The external end wall of each trough is provided with an indentation for the secure cradling of the brush handle.

6 Claims, 5 Drawing Sheets

STACKABLE PAINT ROLLER TRAY WITH INTEGRAL PAINT BRUSH STORAGE TROUGH REST

This is a continuation in part of design patent application Ser. No. 29/950,746 filed Feb. 26, 1996.

FIELD OF THE INVENTION

This invention relates to trays for use with paint rollers and specifically to stackable paint roller trays embodying integral means for the resting of paint brushes therein.

BACKGROUND OF THE INVENTION

A common paint roller tray is generally configured as a rectangular pan, of a width dimension sufficient for insertion of a paint roller therein. The base of the pan is configured to be sloped away from the user, and to terminate in a well in which paint is contained, for rolling insertion of a paint roller and the uniform coating thereof. The upper end of the sloped base is roughened and used to roll off excess paint from the roller prior to usage of the roller.

Though the pan can be placed on any flat surface, a typical advantageous use for paint roller trays is with respect to its being attachable to readily accessible portions of a ladder such as the hinged paint ledge of stepladders. In this position the tray functions as a local source for paint, in a readily usable form, suitable for paint rollers, as opposed to an awkward pail source. To facilitate such usage (which is the primary function of such trays), the paint roller trays are often provided with integrated hook-on members, adapted to engage portions of the ladder used in reaching elevated areas to be painted. Better trays are provided with engagement means which are adaptable to varying configurations and thicknesses of a base support, such as a ladder, for more secure engagement.

In order to increase the versatility of the paint trays, whereby they are also locally utilizable with trim and wall brushes (for use in areas to be painted which not properly covered by rollers, e.g. corners and thin trim) some trays are provided with shallow brush rests integrally formed within the pan, adjacent the shallow part of the tray. Both brush and roller can thus be alternatively utilized by dipping into the paint well, as required and being placed in a support area when not in use. However, brush rests at the shallow part of the tray (adjacent the user) are awkwardly positioned and can impede utilization of the roller brush by confining the room for the roller handle. Positioning brush rests in the deep well of the tray (distal from the user and roller handle) is not readily feasible since it would impede the roller coating with paint and typical deep paint containing wells are too deep for a brush rest.

Another desirable feature of paint trays, particularly from a marketing standpoint or for professionals who utilize multiple trays, is an integral unitary tray configuration which facilitates stacking of trays with minimized use of counter, display, storage or shelf space.

SUMMARY OF THE INVENTION

It is accordingly an object of the present invention to provide a paint roller tray which embodies integral paint brush rests which are completely removed from interference with the primary paint roller utilization of the tray.

It is a further object of the present invention to provide such paint roller trays whereby they are stackable and capable of being supported on ladder rungs of varying thickness.

These and other objects, features and advantages of the present invention will become more evident from the following discussion as well as the drawings in which:

SHORT DESCRIPTION OF THE DRAWINGS

DETAILED DESCRIPTION OF THE INVENTION

Generally the present invention comprises a rectangular paint roller tray defined by four walls and a closed bottom, wherein the bottom is downwardly sloped from a front wall nearest a user thereof, to a rear wall, distal to a user, with the area of the closed bottom adjacent the distal wall comprising a well for containment of paint, and for rolling insertion and loading of a paint roller with the paint contained therein. Sloping of the bottom may terminate at the beginning of the well since the liquid paint will level in the well regardless of bottom slope. Accordingly, with such liquid leveling and identical function, sloping of the bottom is considered to extend to the distal wall, even if the well bottom is flat. The improvement comprises at least one closed bottom trough outside of said tray, with said outside trough integrally depending from the distal wall of the tray, while being spaced therefrom and extending parallel thereto. The trough is adapted to accommodate a significant portion of a paint brush, in an edgewise placement, as a rest therefor. Preferably the trough is tapered to a narrow base to facilitate nesting or stacking of the trays. To this effect the trough is spaced from the distal wall to permit such nesting as well.

In a preferred embodiment, the front wall of the tray extends downwardly for a distance at least as great as that of the depth of the well, whereby the tray can be placed on a flat surface without a forward tilt and possible paint spillage. In addition, a short inwardly (relative to the pan) cantilevered section is provided at the base of the front wall to function as a hook member whereby the front of the tray can be hooked onto a step ladder paint ledge Two narrow based troughs, adapted for accommodation of paint brushes of different types, e.g., trim and wall brushes, depend from the rear wall of the tray, adjacent the deep well, and are spaced therefrom to permit stacked nesting. The paint brush troughs are slopingly narrowed in all dimensions, to permit the stacked nesting while also accommodating a major portion of a brush. The external end wall of each trough is provided with an indentation for the secure cradling of the brush handle.

The troughs, if desired, particularly with respect to the use of the trim brushes, can be partially filled with a paint which is of a different type or color from that used with the roller (to a level which would not cause spillage with insertion of the brush in a rest position). This is however not feasible with prior art paint roller trays wherein the brush rests are adjacent to or in contact with the interior of the tray wherein paints of different types can detrimentally become accidentally mixed.

DETAILED DESCRIPTION OF THE DRAWINGS AND THE PREFERRED EMBODIMENT

Figure 1:
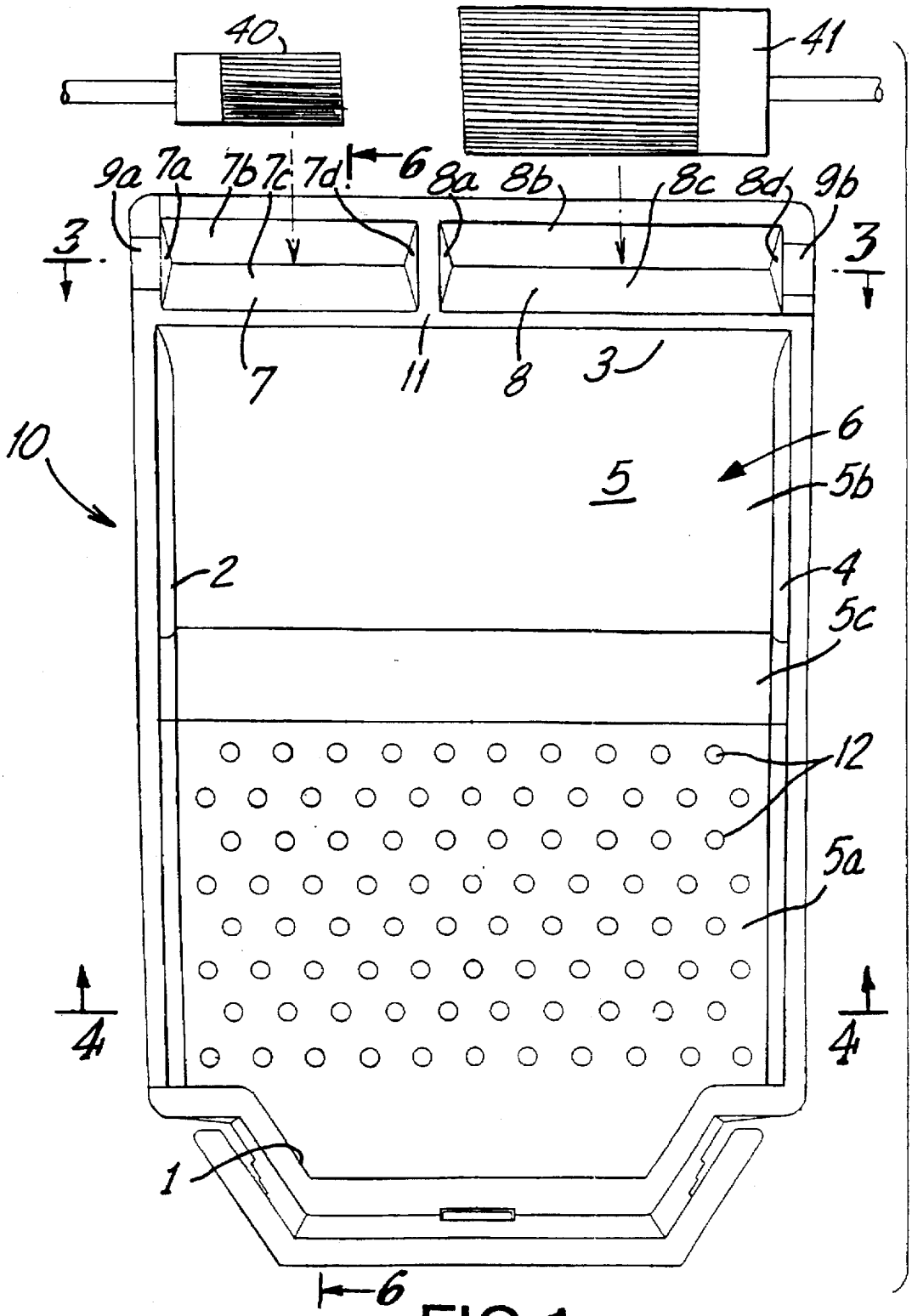
FIG. 1 is a top view of the paint roller tray of the present invention.
Figure 2:
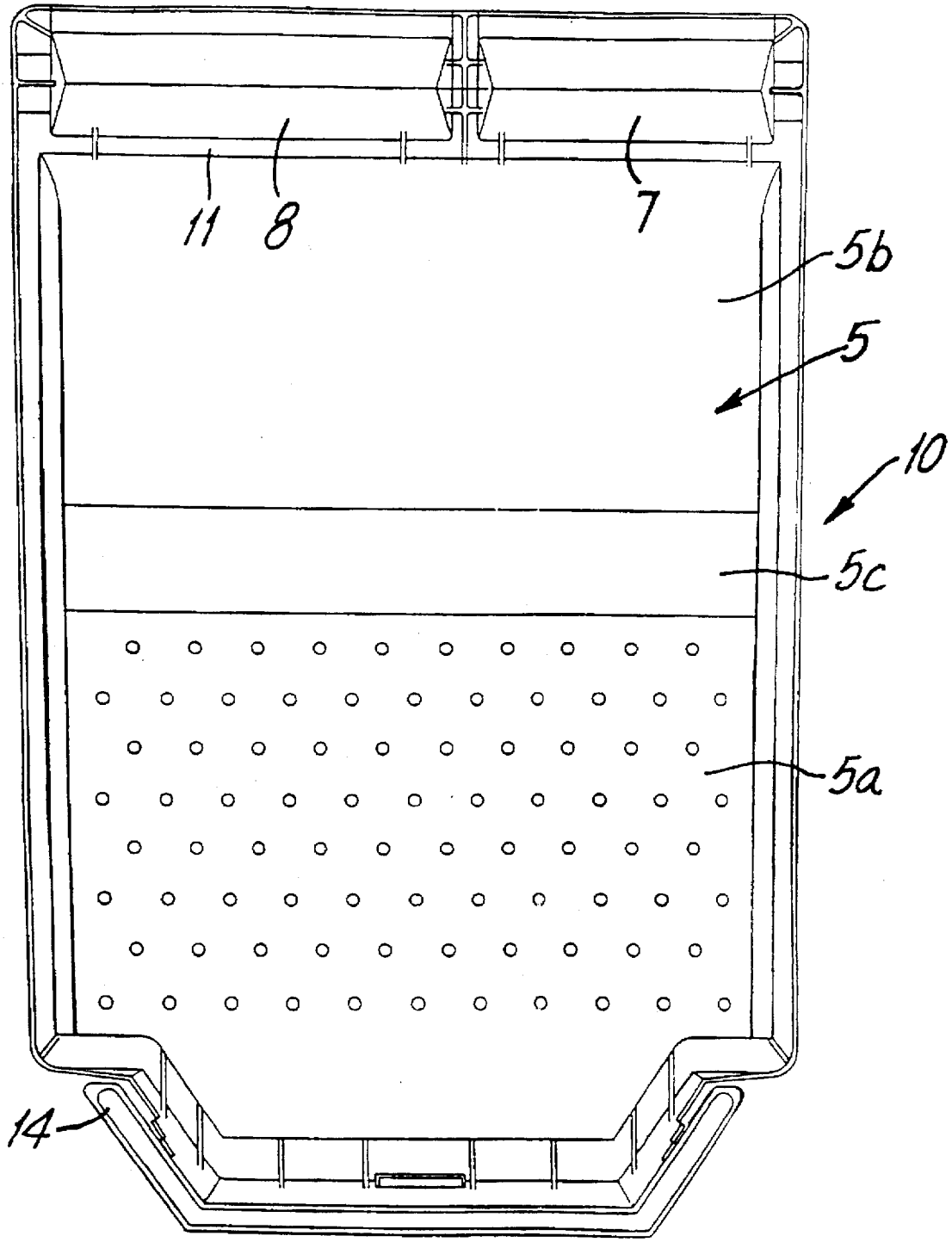
FIG. 2 is a bottom view thereof.
Figure 3:
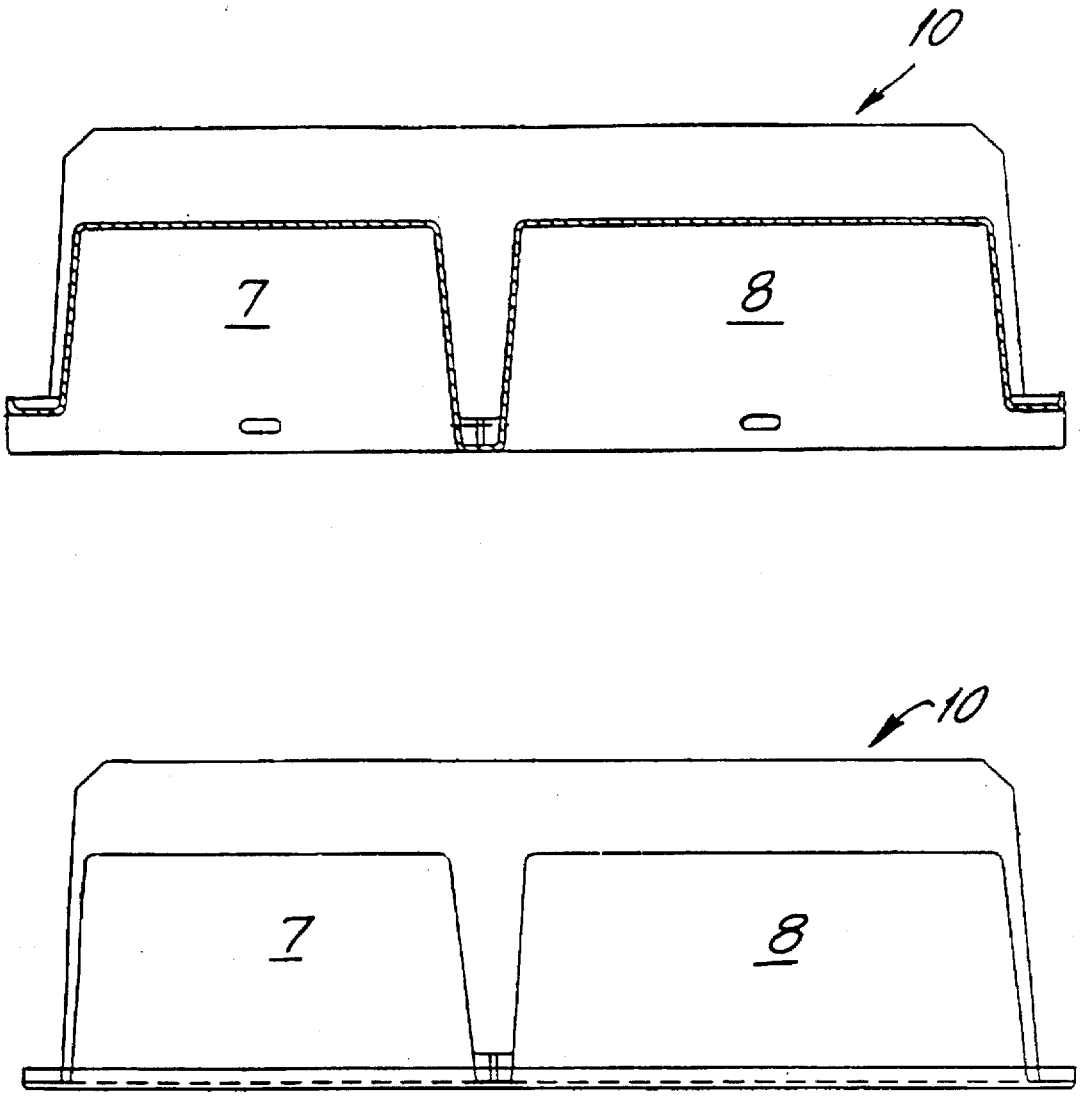
FIG. 3 is a rear view thereof.
Figure 4:
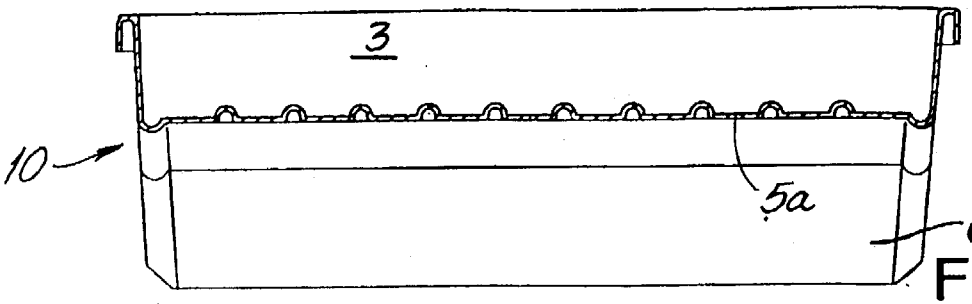
FIG. 4 is a cross section view thereof taken along line 4—4

With specific reference to the drawings, in FIG. 1, the interior of paint roller tray 10 is shown, with such interior being substantially rectangular and defined by front and rear (relative to a use) walls 1 and 3 and right and left side walls 2 and 4. Tray bottom 5 is sloped downwardly from front wall 1 to rear wall 3 and comprises shallow section 5*a*, having raised dimples 12 therein, and deep section 5*b* which defines paint well 6. Steep downgrade section 5*c* connects the shallow and deep sections 5*a* and 5*b* respectively and provides a wall for the well 6. The upper end of section 5*c* loosely defines the upper level of paint to be placed in the well. As more clearly seen in FIGS. 5 and 6, front wall 1, extends downwardly to a level approximately on the same plane as deep section 5*b* whereby when the tray 10 is placed on a flat surface, the slope of the bottom 5 is maintained. Alternatively, the lower end of front wall 1 is provided with a hook element 14 (at both right and left sides of the front wall) which extends for a short distance under base 5. Indentations 5*a–c* in front wall 1, adjacent hook element 14, serve to provide an adapted fitting to ladder or other support elements 45*a–c* shown in phantom.

Figure 5:
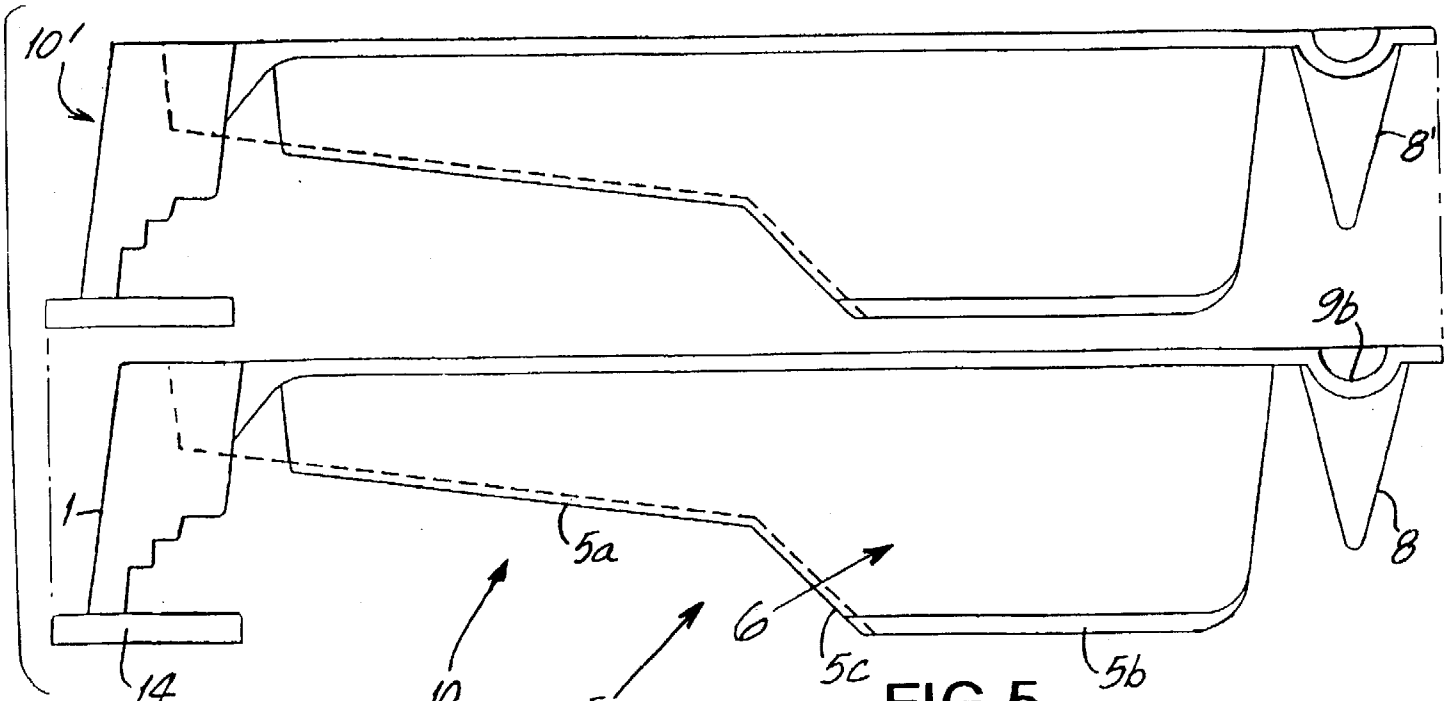
FIG. 5 is a right side view, with a second tray shown in phantom, depicting the stacking engagement.
Figure 6:
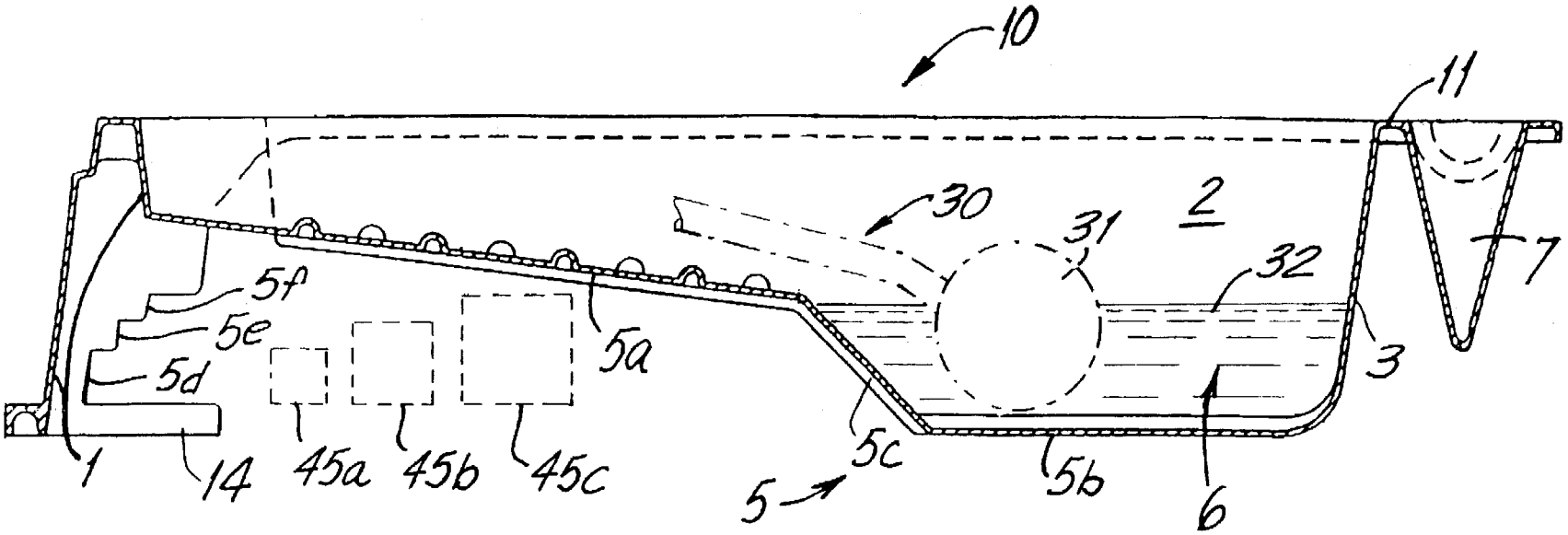
FIG. 6 is a longitudinal sectional view taken along line 6—6 of FIG. 5.

The relative sloping of the base sections 5*a–c* and the defined well 6 are more clearly seen in FIGS. 5 and 6. The roller 31 of paint roller 30, shown in phantom, is inserted into paint 32 in well 6 and rolled therein for complete coating. The roller 31 is then rolled on dimpled section 5*a* to remove excess paint from the roller. The excess paint trickles down the slope of sections 5*a* and 5*c* back into the well 6.

As seen in FIGS. 1–6, in addition to the paint well 6 for the paint roller, tray 10 is integrally provided with troughs 7 and 8 which are exterior to the area bounded by walls 1–4 and are positioned at the rear of the tray (relative to a user). Smaller trough 7 is adapted for use as a brush rest for a smaller trim brush 40 and larger trough 8 is adapted for use as a brush rest for larger wall brush 41. As shown, the troughs 7 and 8 are configured for the edgewise insertion of the brushes 40 and 41 when they are temporarily stored. The upper side edge lips of trough 7 and 8 are configured with cutouts 9*a* and 9*b* respectively, for cradling of the handles of the brushes. Both troughs 7 and 8 integrally depend from the upper edge of rear wall 3 and are spaced therefrom by ledge 11.

Walls 1–4 and trough walls 7*a–d* and 8*a–d* are all downwardly and inwardly slanted to facilitate beveled-type engagement for stacking between several trays, as shown in FIG. 5. The spaced pendency of troughs 7 and 8 from well 6, further permits nesting of the troughs with respective troughs 7' and 8' of a second tray 10' as shown in FIG. 5.

Troughs 7 and 8 are further adapted to contain small amounts of paint for use with the respective brushes 40 and 41, or for containing of run-off from the brushes when temporarily stored.

It is understood that the above description and illustrations are merely exemplary of an embodiment of the present invention and that changes may be made to components, configuration and relative arrangement of elements without departing from the scope of the present invention as defined in the following claims.

What is claimed is:

1. A paint roller tray having an interior defined by four walls and a closed bottom, wherein the bottom is downwardly sloped from a front wall nearest a user of the paint roller tray, to a rear wall, distal to the user, with the area of the closed bottom adjacent the distal wall comprising a well for containment of paint, and for insertion and loading of a paint roller with the paint contained therein, wherein the improvement comprises said paint roller tray further comprising at least one closed-bottom trough outside of said walls, with said at least one trough being integrally dependant from the distal wall of the tray, said at least one trough being spaced therefrom and extending parallel thereto, with the at least-one trough being adapted to accommodate a paint brush, as a rest therefor, wherein the at least one trough is tapered to a narrow base to facilitate nesting or stacking of one paint roller tray with a second identical paint roller tray and wherein the at least one trough depends from upper edge of the rear wall, and wherein the at least one trough is narrow and adapted to hold a significant portion of the paint brush in an edgewise insertion therein.

2. The paint roller tray of claim 1, wherein two troughs depend from said distal wall and wherein the two troughs are adapted to provide a rest for different size and configured brushes.

3. The paint roller tray of claim 1, wherein a portion of the at least one trough is configured as a cradle for a portion of a handle of the brush.

4. The paint roller tray of claim 3, wherein the front wall extends downwardly beyond the closed base to a point substantially in a plane of the base of the well.

5. The paint roller tray of claim 4, wherein the front wall further comprises an extension member extending from the point substantially in a plane of the base of the well, inward and under the base of the tray, whereby the extension member and front wall function as a hook element for attachment to a flat portion of a ladder.

6. The paint roller tray of claim 5, wherein the front wall, adjacent said extension member, comprises means for accommodating different thickness of said flat portion of a ladder.

* * * * *